US005979211A

United States Patent [19]

Pahl et al.

[11] Patent Number: 5,979,211

[45] Date of Patent: Nov. 9, 1999

[54] HYDRAULIC DEEP DRAWING APPARATUS

[75] Inventors: Klaus-Juergen Pahl, Sulzfeld; Dieter Therolf, Vaihingen; Stephan Kruse, Eppingen, all of Germany

[73] Assignee: Maschinenfabrik J. Dieffenbacher GmbH & Co., Eppingen, Germany

[21] Appl. No.: 08/946,836

[22] Filed: Oct. 8, 1997

[30] Foreign Application Priority Data

Oct. 8, 1996 [DE] Germany ..... 196 41 411

[51] Int. Cl.[6] ..... B21D 24/08

[52] U.S. Cl. ..... 72/351

[58] Field of Search ..... 72/350, 351, 453.13

[56] References Cited

U.S. PATENT DOCUMENTS

| | | | |
|---|---|---|---|
| 1,970,134 | 8/1934 | Ferris | 72/358 |
| 3,420,089 | 1/1969 | Myers | 72/351 |
| 4,745,792 | 5/1988 | Story et al. | 72/351 |
| 5,138,857 | 8/1992 | Siegert | 72/351 |
| 5,477,723 | 12/1995 | Kergen | 72/350 |

FOREIGN PATENT DOCUMENTS

| | | |
|---|---|---|
| 0 453 955 | 10/1991 | European Pat. Off. . |
| 37 24 382 | 2/1989 | Germany . |
| 44 35 069 | 4/1996 | Germany . |

*Primary Examiner*—Lowell A. Larson
*Attorney, Agent, or Firm*—Foley & Lardner

[57] ABSTRACT

A hydraulic deep drawing apparatus for a press for drawing shaped sheet metal parts from a workpiece. The apparatus comprises hydraulic pressure cylinders, a sheet holding plate supported by the hydraulic pressure cylinders and onto which the workpiece is laid, a tool baseplate arranged under the sheet holding plate, a ram which moves vertically toward the workpiece until just before contact with the workpiece, and which is fixed to a frame of the press at a gap Δs from the workpiece, and a multipoint unit having plural short stroke cylinders arranged according to a drawing ring contour, the short stroke cylinders being hydraulically actuated to bridge the gap Δs and press the workpiece against a drawing ring. A holding force for deep drawing the workpiece comprises an outer effect ring and an inner effect ring. The outer effect ring is loaded by sheet holding cylinders, and the inner effect ring is loaded by pressure pins and shaping pins.

20 Claims, 9 Drawing Sheets

Schnitt AA

Sheet holding force profiles

Screen display

Fig. 8a
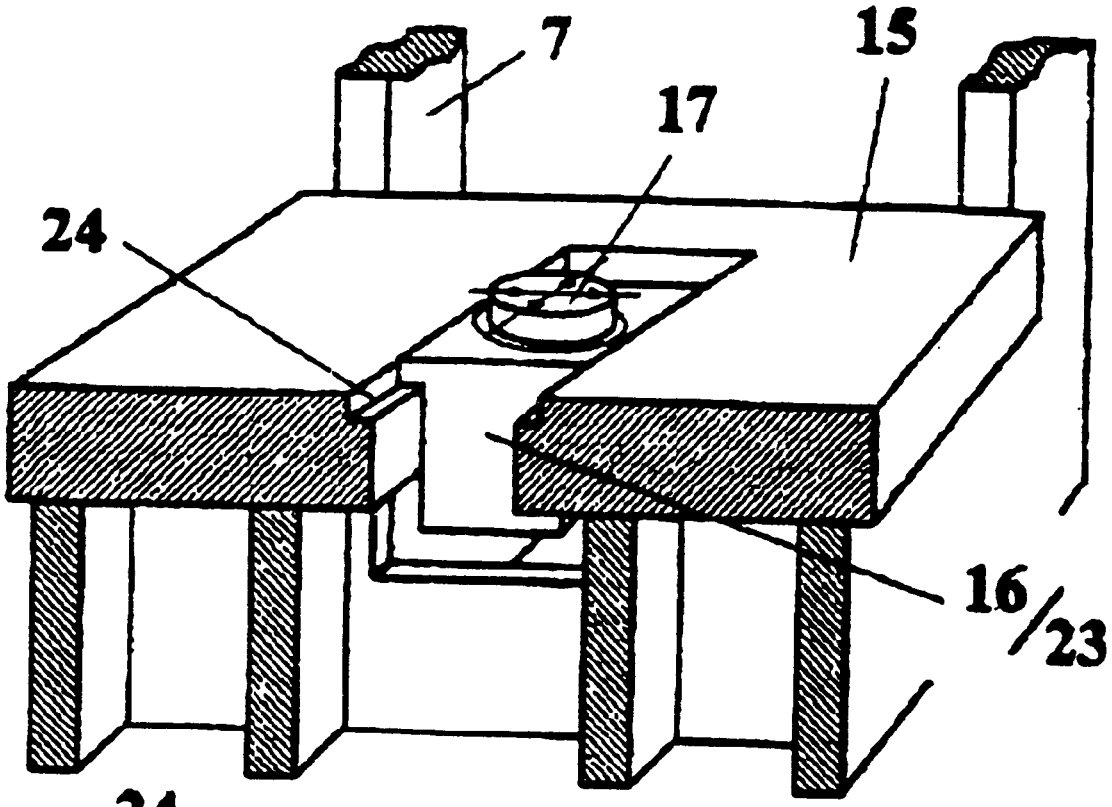
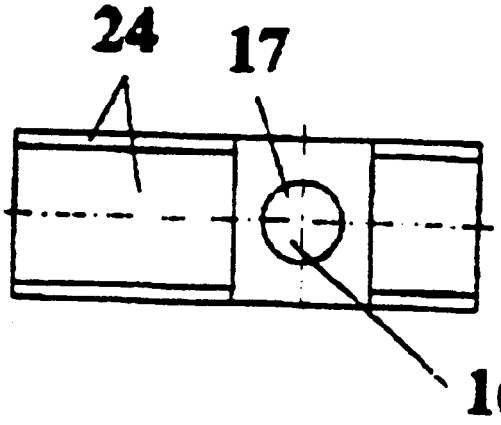
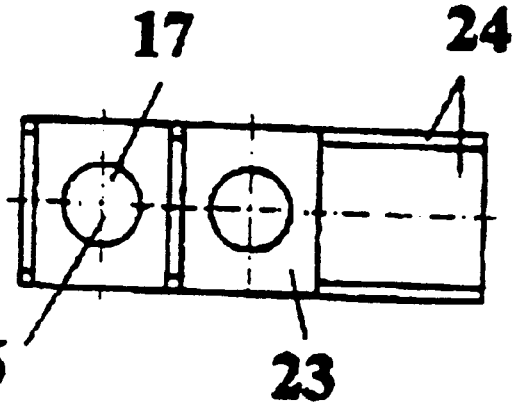
Fig. 8b
Fig. 8c

HYDRAULIC DEEP DRAWING APPARATUS

FIELD OF THE INVENTION

The invention relates to a hydraulic deep drawing apparatus for use in a press. This invention relates more particularly to a hydraulic deep drawing apparatus for drawing shaped sheet metal parts.

BACKGROUND OF THE INVENTION

A hydraulic deep drawing apparatus is disclosed in German Offenlegungsschrift DE 44 35 069. The object of this invention is to configure a press, together with a hydroelastic drawing apparatus, such that existing tools of the previous conventional deep-drawing shaping technology can be used without costly adaptation conversion. The aim is that earlier tools can be run and meet the requirements of a modern CNC-controlled multipoint unit divided into force effect fields.

A significant advantage of the apparatus according to DE 44 35 069 is that tools from conventional, single-acting presses can be used, without laborious and expensive adaptation conversion, for process-controlled, deep drawing shaping using CNC-control multipoint force control. DE 44 35 069 does not solve the problem of different flow behavior of sheet metal workpieces, for example during the production of double sinks having different geometries. Double sinks may, for example, have differing geometries of sink spacing, sink depth, sink radii and sheet metal thickness. In addition, there may be different material qualities of the workpiece. For example, as is known in the art, scraps of paper must in the critical flow front areas. This is time inefficient, particularly when introducing new tools, and can be reproduced only to a limited extent.

SUMMARY OF THE INVENTION

In accordance with one aspect of the present invention, there is provided a hydraulic deep drawing apparatus for a press for drawing shaped sheet metal parts from a workpiece. The apparatus comprises hydraulic pressure cylinders, a sheet holding plate supported by the hydraulic pressure cylinders and onto which the workpiece is laid, a tool baseplate arranged under the sheet holding plate, a ram which moves vertically toward the workpiece until just before contact with the workpiece, and which is fixed to a frame of the press at a gap $\Delta s$ from the workpiece, and a multipoint unit having plural short stroke cylinders arranged according to a drawing ring contour, the short stroke cylinders being hydraulically actuated to bridge the gap $\Delta s$ and press the workpiece against a drawing ring. A holding force for deep drawing the workpiece comprises an outer effect ring and an inner effect ring. The outer effect ring is loaded by sheet holding cylinders, and the inner effect ring is loaded by pressure pins and shaping pins.

Objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred exemplary embodiments of the invention, and, together with the general description given above and the detailed description of the preferred embodiments given below, serve to explain the principles of the invention. In the drawings, like numerals indicate like parts.

FIG. 8*a* illustrates a perspective view of an arrangement of shaping cylinders in a table plate;

FIG. 8*b* illustrates a displaceable shaping cylinder with a drawing piston in a guide of the table plate; and FIG. 8*c* illustrates an arrangement of two shaping cylinders with drawing pistons in the table plate.

DETAILED DESCRIPTION OF THE PREFERRED EMBODIMENTS

Figure 1:
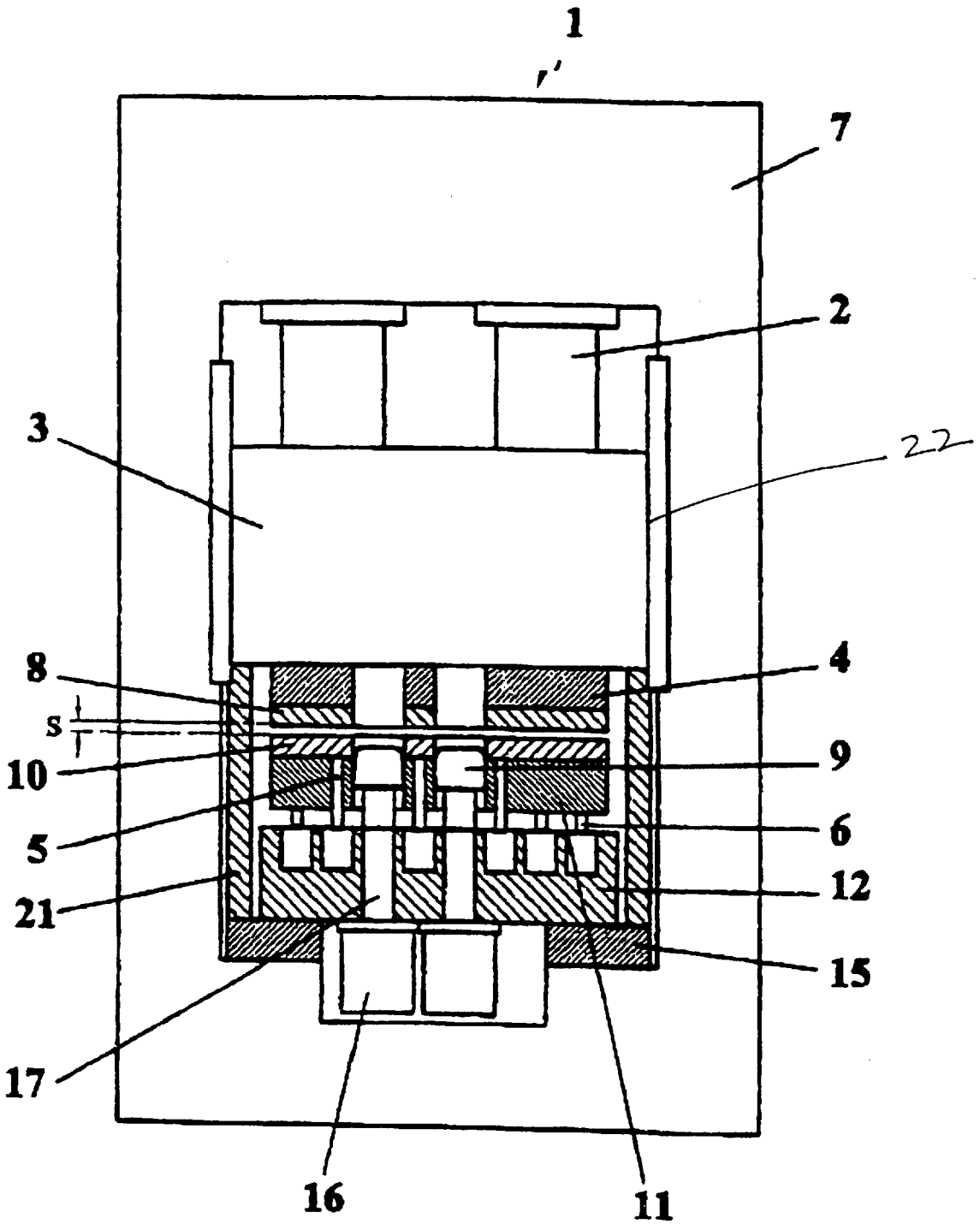
FIG. 1 illustrates a press with a deep drawing apparatus according to the invention.

FIG. 1 illustrates a press 1 in a closed working position before the deep drawing operation occurs. The press 1 includes a deep drawing apparatus according to the present invention. A workpiece 19 is not shown. In the present invention, the press 1 includes a clamping device, wherein closing cylinders 2 move the dead weight of ram 3, intermediate plate 4, and drawing ring 8 hydraulically and vertically in the course of an opening or closing movement. In the closed position, shaping forces occurring during the deep drawing shaping operation and sheet holder forces are absorbed statically by spacers 21. A hydraulically controlled, mechanical locking unit can be used in the lower closed position, instead of the spacers 21, to intercept forces occurring between the lower table construction of the press frame 7 and the ram 3.

Figure 2:
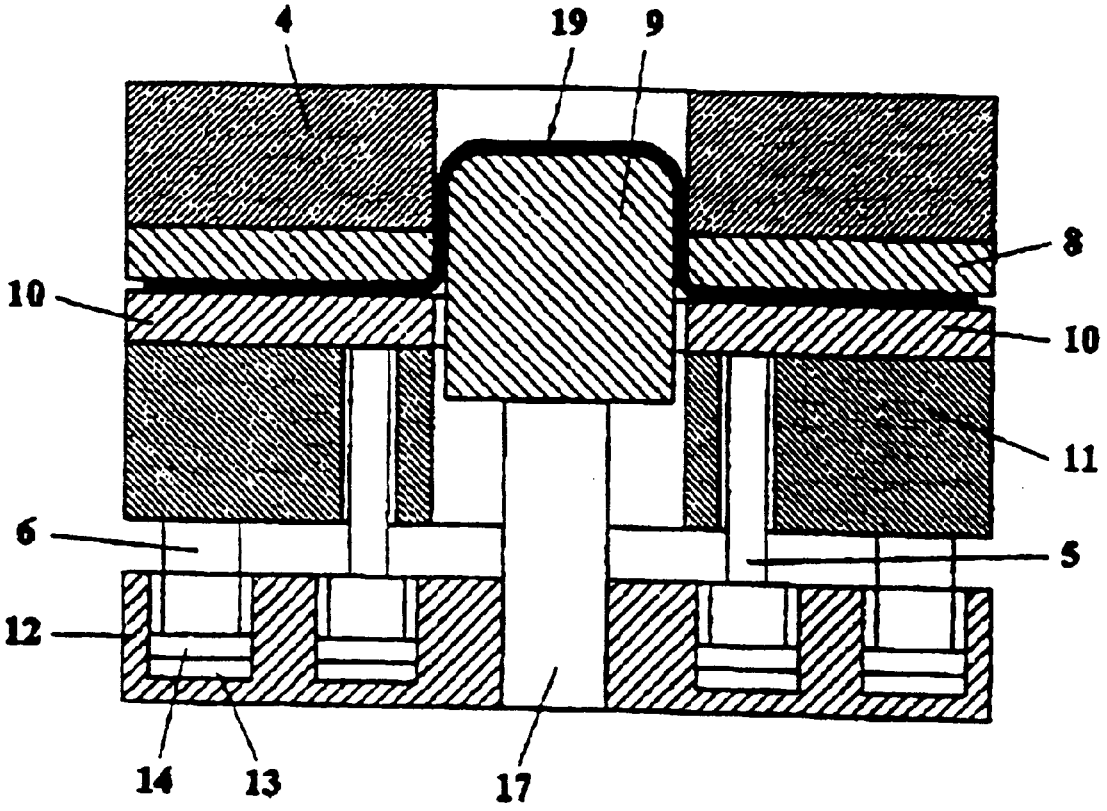
FIG. 2 illustrates a multipoint control unit and a detailed view of the deep drawing apparatus of FIG. 1.

In FIG. 2, a drawing tool and a multipoint unit 12 are illustrated in detail. A lower half of the drawing tool comprises a drawing punch 9, a sheet holding plate 10, a tool baseplate 11, pressure pins 5 and shaping pins 20. The multipoint unit 12 comprises sheet holding cylinders 13 (designed as short stroke cylinders) and short stroke pistons 14. The drawing ring 8 is firmly connected to the intermediate plate 4, and is raised and lowered with the ram 3.

The short stroke pistons 14 of the multipoint unit 12 are constructed such that they can be used for a product family of similar parts which have different dimensions. The relationship between the product shape (e.g., a rectangular shape of the drawing ring 8 ) and the cylinder positions is determinative of whether control of the material flow in the pressure and tension areas is achieved in the most efficient manner. Compared to conventional single-acting and double-acting presses, using a short stroke cylinder having an installed stroke of only a few millimeters allows more flexibility for placement of actuators along the workpiece surface. This is achieved in combination with an improved dynamic behavior of the hydraulic system, and facilitates programming of complex sheet holding force profiles which precisely satisfy the requirements necessary for each stage of the drawing process.

A holding force of the sheet holding cylinders 13 comprises an outer effect ring 25 and an inner effect ring 26. The outer effect ring 25 acts with an adjustable, constant basic load on the tool baseplate 11, using basic load pressure pins 6. Effective points of the inner effect ring 26 act on the sheet holding plate 10 through appropriately shaped openings in the tool baseplate 11 through which the pressure pins 5 and shaping pins 20 extend. The effective points can be loaded individually or in groups in a deliberately controlled manner. The effect rings 25 and 26, delimited from each other by a separating line 30 (drawn as thick dashed lines), are clearly illustrated in FIGS. 3*a* and 3*b*. In a close grid field, the sheet holding cylinders 13 and the short stroke pistons 14 surround a drawing ring contour 18 in a manner corresponding to the workpiece to be drawn. A table plate 15 (see FIGS. 8*a* and 8*b*) has, primarily in a central area of a clamping surface, cut-outs with guides 24 for housings 23 of shaping cylinders 16 and shaping pistons 17. Depending on the geometry of the drawing punch 9, an appropriate number of hydraulic shaping pistons 17 may be provided.

This arrangement of movable cylinder units as drawing drives, placed in a lower crossmember of the press, undertakes the drawing function for parts having different geometries. By separating the drawing function from the multipoint unit 12, the press 1 can easily be adapted to various product groups by exchanging the multipoint unit 12 and adapting the positions of the shaping cylinders 16 and shaping pistons 17.

The functional sequence of a deep drawing operation is as follows: when the press 1 is open, the workpiece 19 is laid onto the sheet holding plate 10 and the drawing punch 9. In a rapid closing movement, the ram 3 is lowered along guide rails 22, hydraulically or mechanically, until there is a narrow gap Δs, of about 0.5 mm to 5 mm between the ram 3 and the workpiece 19. The ram 3 is either supported by spacers 21 (wherein a force used to set the ram must be greater than an overall effective process force) or is fixed by a mechanical/hydraulic locking unit. The gap spacing s is equal to the sheet thickness of the workpiece 19 plus the gap Δs. Locking the ram 3 with the gap Δs between the ram 3 and the workpiece 19 eliminates dynamic impact shock on the workpiece 19, even upon a very rapid closing movement. Complex deceleration procedures of conventional drawing cushion plates are therefore unnecessary.

After the ram 3 has been fixed or locked, the sheet holding cylinders 13 and short stroke pistons 14 are hydraulically activated. The sheet holding plate 10 is lifted hydraulically through the gap Δs, pressing the workpiece 19 against the drawing ring 8. When the gap Δs has been bridged and the desired positions of the sheet holding cylinders 13 or cylinder groups have been reached, the movement of the drawing punch 9 for the drawing stroke begins. During the deep drawing stroke, the pressures in the sheet holding cylinders 13 or cylinder groups are varied in accordance with the different material flow in the drawing and pressure shaping area (e.g., in the pressure shaping area of material thickening, as a result of concentric flowing together of material and material thickening in a side wall flange) by a computer control system. The pressure pins 5 and shaping pins 20 are arranged along the drawing ring contour 18 of the sink geometry, corresponding to the respective drawing and pressure shaping areas.

Figure 3A:
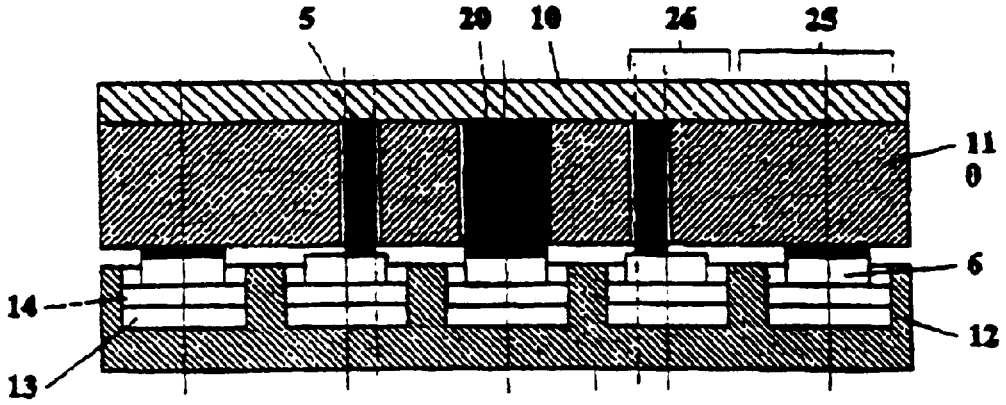
FIG. 3*a* illustrates a multipoint control unit according to FIG. 1, taken along section A—A of FIG. 3*b;*
Figure 3B:
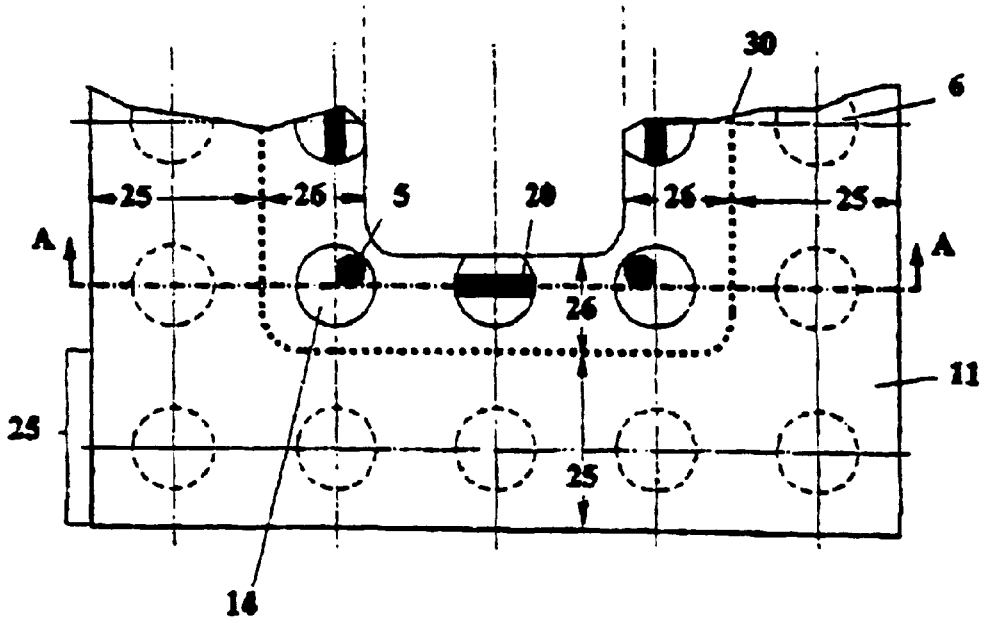
FIG. 3*b* illustrates an arrangement of a sheet holding cylinder for an outer and inner effect ring for a part having a rectangular contour.
Figure 4:
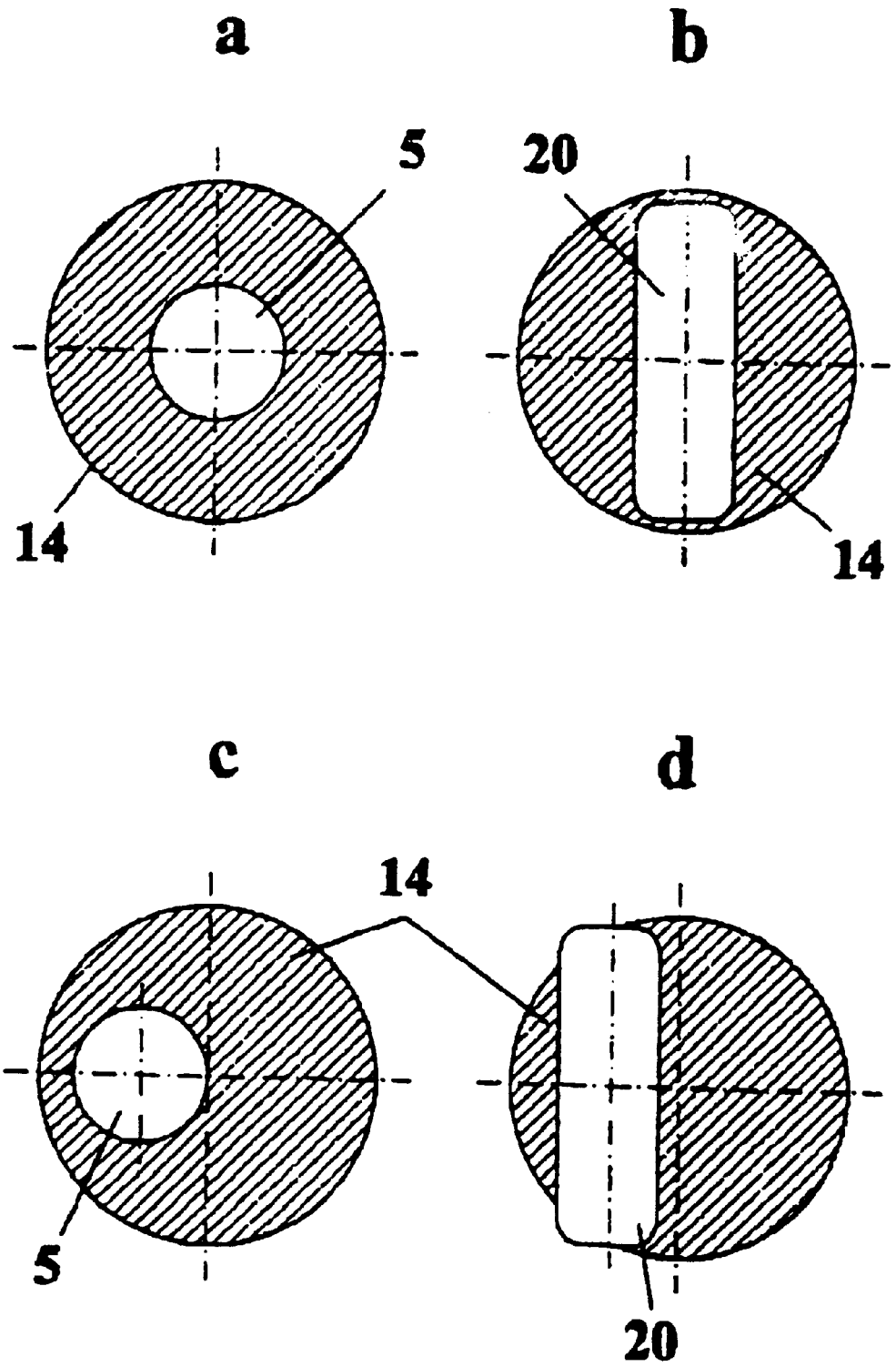
FIG. 4*a* illustrates a round pressure pin centrally arranged on an effective surface of the sheet holding cylinder.
FIG. 4*b* illustrates a rectangular pressure pin centrally arranged on an effective surface of the sheet holding cylinder.
FIG. 4*c* illustrates a round pressure pin eccentrically arranged on an effective surface of the sheet holding cylinder.
FIG. 4*d* illustrates a rectangular pressure pin eccentrically arranged on an effective surface of the sheet holding cylinder.
Figure 5A:
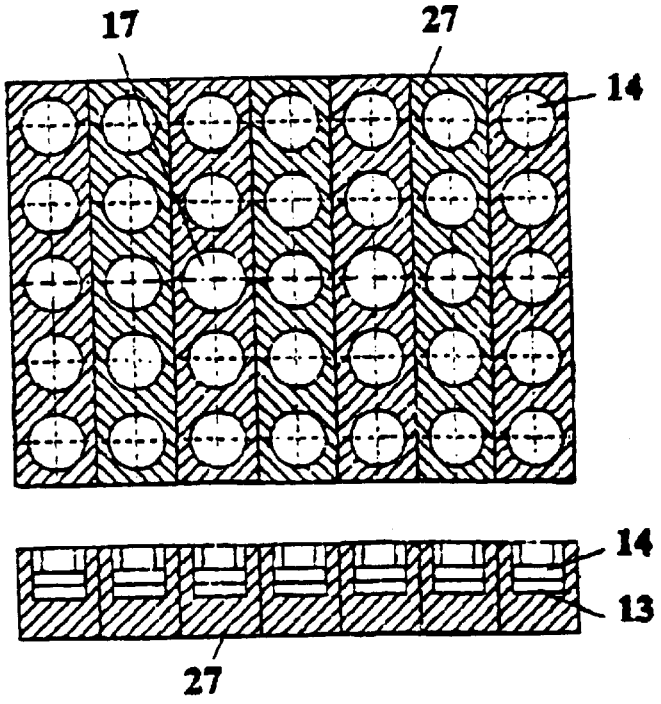
FIG. 5*a* illustrates a multipoint unit having exchangeable module strips arranged alongside one another.
Figure 5B:
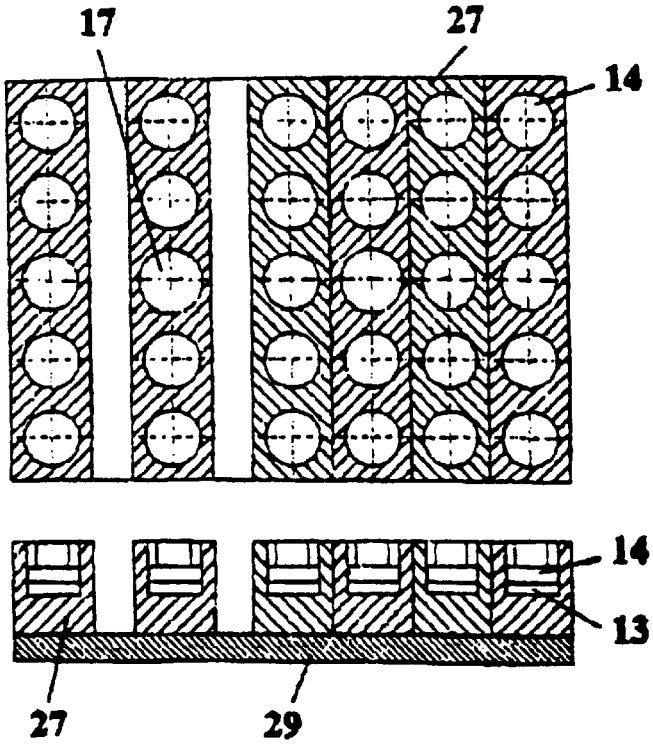
FIG. 5*b* illustrates a multipoint unit having arbitrarily arranged module strips on a common carrier plate.
Figure 5C:
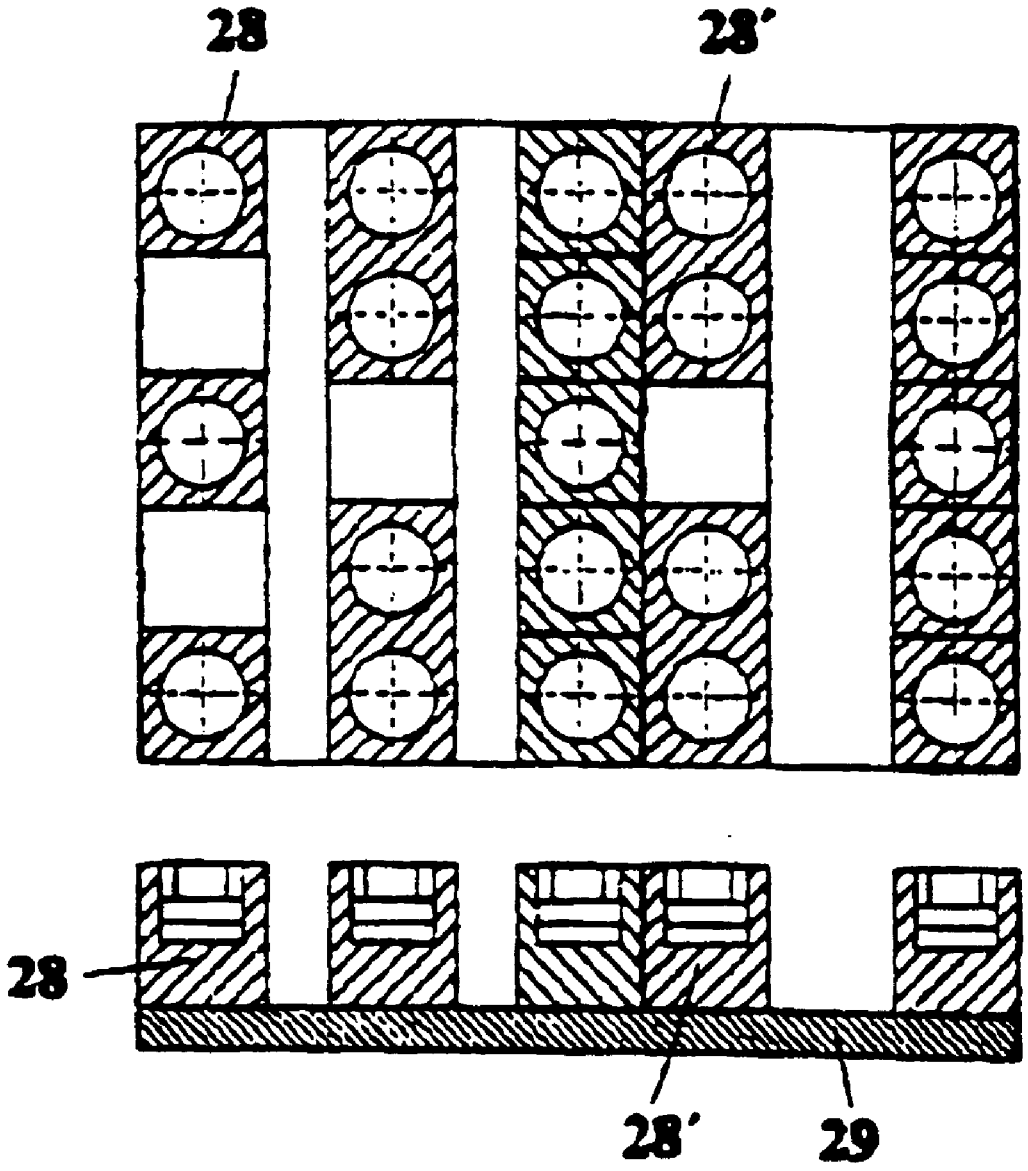
FIG. 5*c* illustrates a multipoint unit having different module designs, arbitrarily arranged on a common carrier plate.

As can be seen in FIGS. 3*a*, 3*b* and 4, the short stroke pistons 14 have an effective surface which is sufficiently larger than the pressure pins 5, and the shaping pins 20 in the tool baseplate 11 can be arranged eccentrically on the effective surface of the short stroke piston 14, corresponding to the drawing ring contour 18 or drawing punch contour. Therefore, it is necessary for the tool baseplate 11 to correspond to the shape of the pressure pins 5 and shaping pins 20. The shaping pins 20 can be appropriately adapted to the workpiece shape or to the drawing ring contour 18. FIGS. 5*a*, 5*b*, 5*c*, 7*a* and 7*b*, illustrate that, by different arrangement of the pressure pins 5 and shaping pins 20 on the effective surfaces of the sheet holding cylinders 13, adaptation of the press 1 to create similar workpieces of a part family is ensured. The multipoint unit 12 is designed to be assembled from a plurality of change module strips 27, and thus can produce workpieces of varying dimensions. FIGS. 5*a*, 5*b* and 5*c* illustrate construction of a tool baseplate 11 using change strips 27 or change modules 28 and 28', which can be fixed on a carrier plate 29 in accordance with a workpiece of a part family.

Figure 6A:
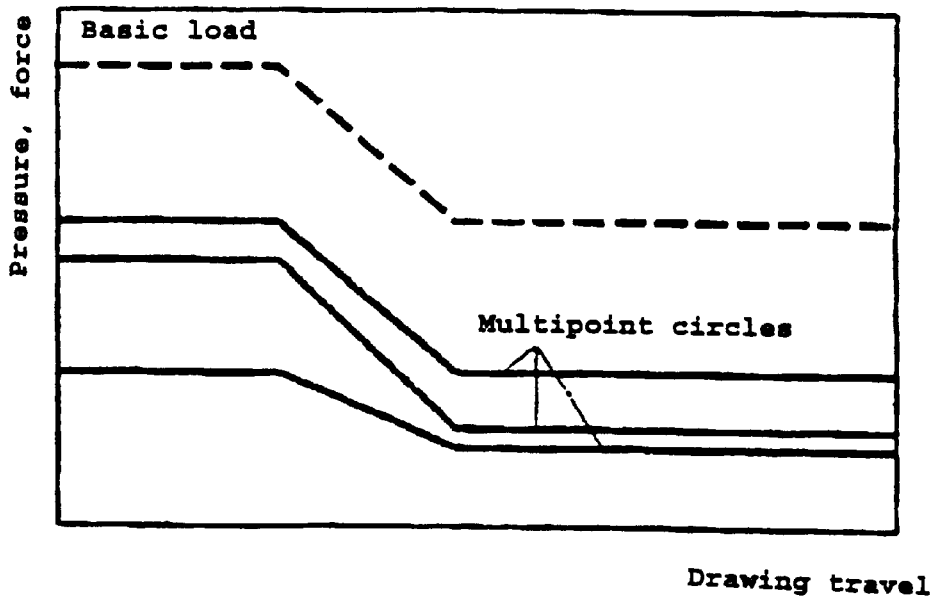
FIG. 6*a* illustrates pressure profiles during a drawing travel.

FIG. 6*a* illustrates pressure profiles during the drawing travel.

Figure 6B:
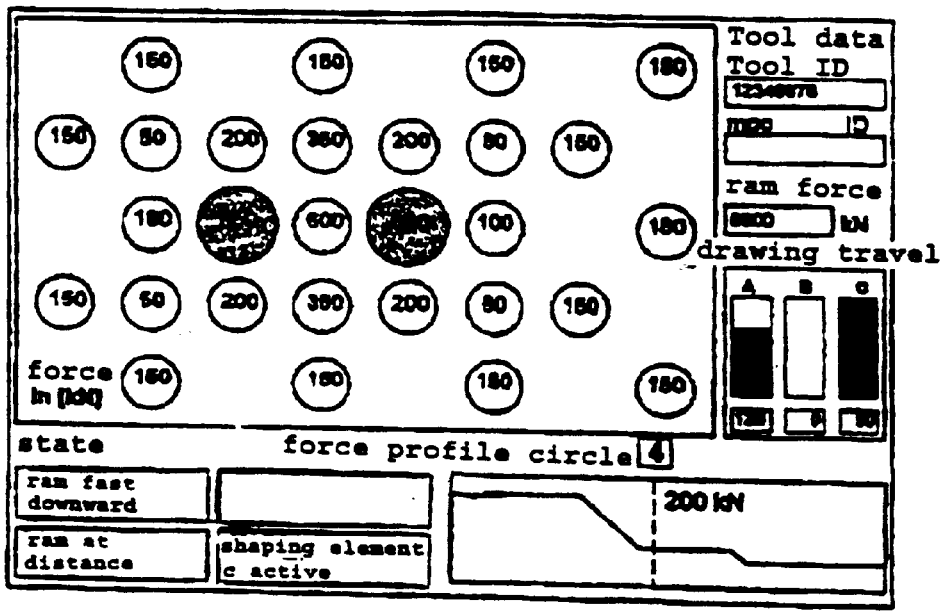
FIG. 6*b* illustrates the screen display of press parameters.
Figure 7A:
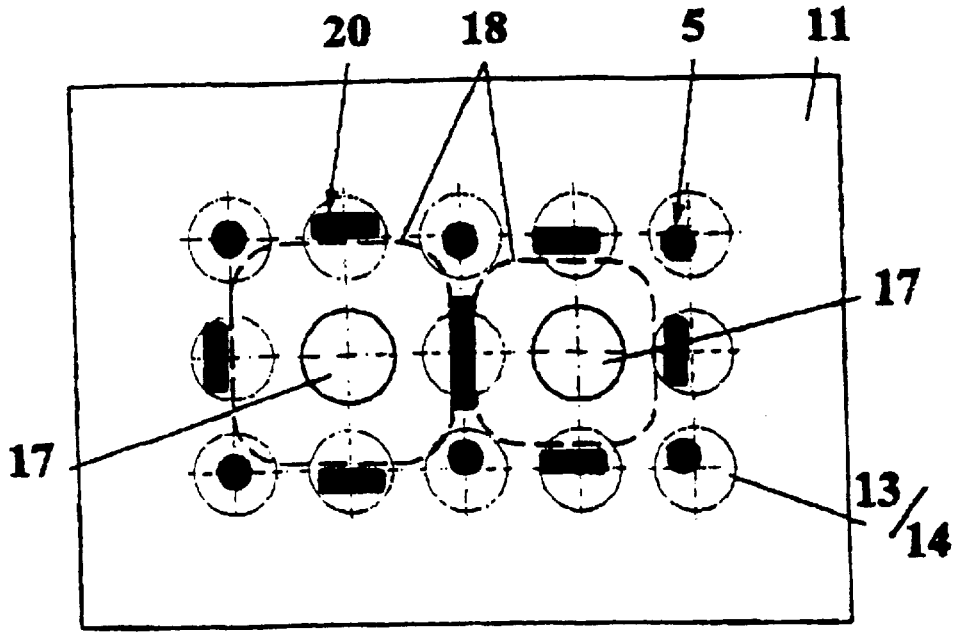
FIG. 7*a* illustrates a tool baseplate with inserted pressure pins and a short stroke piston position for an inner effect ring of a double sink.
Figure 7B:
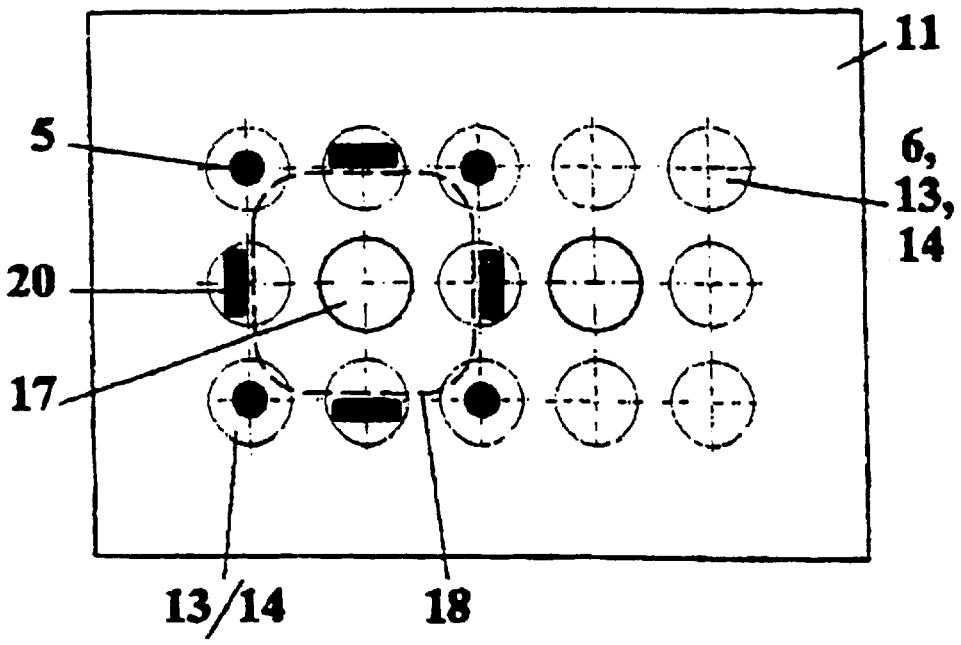
FIG. 7*b* illustrates a tool baseplate with inserted pressure pins and a short stroke piston position for an inner effect ring of a double-bowl sink.

FIG. 6*b* illustrates how families of workpieces can be developed by entering drawing tool parameters into a computer, and can be displayed by a programmable display on a monitor. The monitor has starting values in kN for drawing a double-bowl sink having bowls of different sizes. In the fields illustrated at the bottom left of the monitor, the following states can be displayed:

| | | |
|---|---|---|
| ram fast downward | multipoint starting value reached | drawing travel reached |
| ram at distance | shaping element c active | relieving |
| ram pressure reached | shaping elements A/B active | ram fast upward |

The object of the invention is to provide a hydraulic deep drawing apparatus enabling reproducible deep drawing with the widest range of effect parameters (.e.g., material properties, greasing, lubrication, temperature, etc.), to create a workpiece of suitable form and quality without continual manual correction being necessary. Manual correction may, for example, entail placing scraps of paper underneath sheet holding plates or drawing rings in the critical flow front areas.

Simple and reproducible drawing of the sheet metal workpiece is achieved by an outer effect ring being loaded by a tool baseplate onto a sheet holding plate with an adjustable basic load component of a sheet holding force. Pressure pins do not act on the sheet holding plate, but rather on flat surfaces of the tool baseplate. An inner effect ring, on the other hand, has effective points or effective surfaces which can be driven deliberately, individually or in groups, corresponding to the drawing ring geometry. By means of a high concentration of force at critical points (e.g., in the dividing web area of a double sink), flowing in of workpiece material can be braked, and can be controlled along a drawing ring contour by suitable setting of force profiles in the hydraulic sheet holding cylinders.

Separation of the sheet holding function into two different functional levels is advantageous. A hydraulic circuit acts as the basic load (external effect ring) on the tool baseplate, which is arranged underneath the actual sheet holding plate. The basic load creates an adjustable, uniform sheet holding force over the entire metal sheet. In addition, various cylinders are grouped (inner effect ring) in the vicinity of the drawing ring radius and act directly on the sheet holder. These cylinders precisely control the flow of material in the critical areas close to the shaping zone. Therefore, the sheet holding cylinders are advantageously equipped with a large effective surface in order to achieve optimal effective points using pressure pins of a wide range of shapes.

The multipoint unit is designed for production of parts of a workpiece family, which can be interchanged wholly, or in part, for the adaptation to other workpiece part families, making use of available electrical and hydraulic control and regulating apparatus of the press. The arrangement of a separate multipoint unit ensures reproducible transference of the desired sheet holding force when a ram achieves a spacing of Δs from the workpiece. Fixing of the ram thus ensures reproducible operating conditions, without tilting, even upon introduction of a large eccentric load. The ram is influenced only slightly by an eccentric load torque. In particular, the sheet holding force distribution is not changed during the drawing process by tilting of the ram.

This development stage of the multipoint control system according to the invention (based on a hydraulic press, a multipoint unit for the sheet holder function, and flexible shaping elements as the drawing punch drive) enables a reproducible deep drawing process for difficult parts. By separating the sheet holding function from the ram function, matching a multipoint unit and shaping elements to a partial geometry and positioning the multipoint unit and shaping elements such that an introduction of force takes place centrally, achieves improved process stability. Computerized press control ensures simplified handling of complex parameter settings. This results in reduced setting times, minimized consumption of material, and a reduced rejection rate. Application of computerized press control in the field of the shaping stainless steel kitchen sinks has confirmed the improvement in process control.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

The disclosure of DE 196 41 411.3 filed Oct. 8, 1996, (the priority document here) is incorporated by reference in its entirety.

What is claimed is:

1. A hydraulic deep drawing apparatus for a press for drawing shaped sheet metal parts from a workpiece, the apparatus comprising:

a shaping cylinder and a shaping piston;

a drawing punch movable in a drawing direction and guided by the shaping cylinder and shaping piston;

a ram which moves vertically toward the workpiece until just before contact with the workpiece, and which is fixed to a frame of the press at a gap Δs from the workpiece;

a multipoint unit having sheet holding cylinders and short stroke pistons arranged according to a drawing ring contour, wherein the sheet holding cylinders and the short stroke pistons are hydraulically actuated to bridge the gap Δs and press the workpiece against a drawing ring;

a sheet holding plate supported by the sheet holding cylinders and the short stroke pistons and onto which the workpiece is laid; and a tool baseplate arranged between the sheet holding plate and the multipoint unit;

wherein a holding force for deep drawing the workpiece comprises an outer effect ring and an inner effect ring, the outer effect ring being loaded hydraulically with an adjustable basic load applied by basic load pressure pins to the tool baseplate, and the inner effect ring being loaded by other pressure pins and shaping pins arranged individually or in predetermined groups.

2. The hydraulic deep drawing apparatus as claimed in claim 1, wherein the other pressure pins and the shaping pins can be arranged either centrally or eccentrically on the effective surfaces of the short stroke pistons.

3. The hydraulic deep drawing apparatus as claimed in claim 2, wherein varying an arrangement of the other pressure pins and the shaping pins on the effective surfaces of the short stroke pistons facilitates adaptation of the apparatus to draw similar workpieces of a part family.

4. The hydraulic deep drawing apparatus as claimed in claim 3, wherein the multipoint unit comprises at least two change modules, and variation of the change modules facilitates production of varying workpieces.

5. The hydraulic deep drawing apparatus as claimed in claim 4, further comprising a pictorial display of a sheet holding and shaping operation of the press, and storage of tool-specific data sets by entering tool parameters into a computer.

6. The hydraulic deep drawing apparatus as claimed in claim 5, further comprising a table plate having guides, and wherein at least one hydraulic cylinder is arranged in a housing displaceably and interchangeably inserted into the guides.

7. The hydraulic deep drawing apparatus as claimed in claim 6, wherein the shape of the other pressure pins and the shape of the shaping pins correspond to the drawing ring contour.

8. The hydraulic deep drawing apparatus as claimed in claim 2, further comprising a table plate having guides, and wherein at least one hydraulic cylinder is arranged in a housing displaceably and interchangeably inserted into the guides.

9. The hydraulic deep drawing apparatus as claimed in claim 1, wherein varying an arrangement of the other pressure pins and the shaping pins on the effective surfaces of the short stroke pistons facilitates adaptation of the apparatus to draw similar workpieces of a part family.

10. The hydraulic deep drawing apparatus as claimed in claim 9, further comprising a table plate having guides, and wherein at least one hydraulic cylinder is arranged in a housing displaceably and interchangeably inserted into the guides.

11. The hydraulic deep drawing apparatus as claimed in claim 1, wherein the multipoint unit comprises at least two change modules, and variation of the change modules facilitates production of varying workpieces.

12. The hydraulic deep drawing apparatus as claimed in claim 1, further comprising a pictorial display of a sheet holding and shaping operation of the press, and storage of tool-specific data sets by entering tool parameters into a computer.

13. The hydraulic deep drawing apparatus as claimed in claim 1, further comprising a table plate having guides, and wherein at least one hydraulic cylinder is arranged in a housing displaceably and interchangeably inserted into the guides.

14. The hydraulic deep drawing apparatus as claimed in claim 1, wherein the shape of the other pressure pins and the shape of the shaping pins correspond to the drawing ring contour.

15. A hydraulic deep drawing apparatus for a press, comprising:

a multipoint unit having sheet holding cylinders and short stroke pistons;

a sheet holding plate supported by the short stroke pistons and onto which a workpiece is laid;

a tool baseplate arranged between the sheet holding plate and the multipoint unit; and a ram which moves vertically toward the workpiece until just before contact with the workpiece, and which is fixed to a frame of the press at a gap $\Delta s$ from the workpiece, wherein the sheet holding cylinders and the short stroke pistons are hydraulically actuated to bridge the gap $\Delta s$ and press the workpiece against a drawing ring, and wherein a holding force for deep drawing the workpiece comprises an outer effect ring and an inner effect ring, the outer effect ring being loaded by basic load pressure pins fixed to a first group of the short stroke pistons, and the inner effect ring being loaded by pressure pins and shaping pins fixed to a second group of the short stroke pistons.

16. The hydraulic deep drawing apparatus as claimed in claim 15, wherein the other pressure pins and the shaping pins can be arranged either centrally or eccentrically on the effective surfaces of the short stroke pistons.

17. The hydraulic deep drawing apparatus as claimed in claim 15, wherein varying an arrangement of the other pressure pins and the shaping pins on the effective surfaces of the short stroke pistons facilitates adaptation of the apparatus to draw similar workpieces of a part family.

18. The hydraulic deep drawing apparatus as claimed in claim 15, wherein the multipoint unit comprises at least two change modules, and variation of the change modules facilitates production of varying workpieces.

19. The hydraulic deep drawing apparatus as claimed in claim 15, further comprising a pictorial display of a sheet holding and shaping operation of the press, and storage of tool-specific data sets by entering tool parameters into a computer.

20. The hydraulic deep drawing apparatus as claimed in claim 15, further comprising a table plate having guides, and wherein at least one hydraulic cylinder is arranged in a housing displaceably and interchangeably inserted into the guides.

* * * * *